US005825343A

United States Patent [19]

Moon

[11] Patent Number: 5,825,343

[45] Date of Patent: Oct. 20, 1998

[54] DRIVING DEVICE AND DRIVING METHOD FOR A THIN FILM TRANSISTOR LIQUID CRYSTAL DISPLAY

[75] Inventor: Seung-Hwan Moon, Seoul, Rep. of Korea

[73] Assignee: Samsung Electronics Co., Ltd., Kyungki-do, Rep. of Korea

[21] Appl. No.: 584,444

[22] Filed: Jan. 11, 1996

[30] Foreign Application Priority Data

Jan. 11, 1995 [KR] Rep. of Korea ..... 1995-406

[51] Int. Cl.[6] ..... G09G 3/18

[52] U.S. Cl. ..... 345/94; 345/92; 345/208; 345/204

[58] Field of Search ..... 345/87, 94, 92, 345/99, 204, 208, 95, 96, 209, 210, 213; 348/790; 349/38, 41, 47, 42, 43

[56] References Cited

U.S. PATENT DOCUMENTS 4,651,148 3/1987 Takeda et al. ..... 345/92

5,568,163 10/1996 Okumura ..... 345/100

5,598,177 1/1997 Mizukata et al. ..... 345/92

*Primary Examiner*—Lun-Yi Lao

*Attorney, Agent, or Firm*—Cushman Darby & Cushman IP Group of Pillsbury Madison & Sutro LLP

[57] ABSTRACT

A driving device and a method of driving a TFT-LCD uses a two-pulse electrode voltage to thereby double the duration of the driving impulse. The driving device includes a liquid crystal interface IC which outputs a two-pulse start signal and a clock signal. A gate bus driver IC outputs a two-pulse gate electrode voltage to each gate line according to the start signal inputted from the liquid crystal interface IC and a liquid crystal pixel is driven by the difference in potential between a grey voltage and a common electrode voltage after the TFT in each gate line is driven by the two-pulse gate electrode voltage input from the gate bus driver IC.

8 Claims, 8 Drawing Sheets

DRIVING DEVICE AND DRIVING METHOD FOR A THIN FILM TRANSISTOR LIQUID CRYSTAL DISPLAY

BACKGROUND OF THE INVENTION

1. Field of the Invention

The present invention relates to a driving device and a method of driving a thin film transistor liquid crystal display (hereinafter referred to as a TFT-LCD), and more particularly, to a driving device and method of driving a TFT-LCD when the driving pulse applied to the liquid crystal capacitor to drive the liquid crystal is not sufficient because the liquid crystal capacitor in a TFT-LCD pixel is not sufficiently charged.

2. Description of the Related Art

Following the current trend of miniaturizing household electric appliances, flat panel display devices have grown increasingly popular as substitutes for cathode ray tubes, and are now being produced on a commercial scale.

Liquid crystal displays, among the various types of flat panel displays, can be operated by a large scale integration (LSI) driver because they are capable of being driven by a low-voltage power supply and have low power consumption. Accordingly, LCDs have been widely applied to laptop computers, pocket computers, automobiles, and color televisions, etc.

TFT-LCDs operate by using twisted nematic (TN) liquid crystals and typically have both a transistor and a storage capacitor in each pixel. The transistor is typically made of a thin film, such as amorphous silicon, on a glass substrate. Since a TFT-LCD can only turn on a pixel by inputting a signal to operate the transistor of each pixel, crosstalk is not generated.

Each pixel typically also includes a storage capacitor, e.g. of a thin film type, which is connected with a liquid crystal capacitance $C_{lc}$ in parallel. The storage capacitor stores an electric charge, so that the screen display is maintained during a non-selected period.

The conventional driving device of a TFT-LCD will now be explained with reference to FIGS. 1–4.

FIG. 1 is an equivalent circuit diagram of pixels in a conventional TFT-LCD which has a wiring structure using the adjacent gate method in which the upper terminal of the storage capacitor $C_s$ is connected to an adjacent gate line.

In a conventional TFT-LCD pixel, one side terminal of the storage capacitor $C_s$ is connected to a contact point between a drain terminal of the TFT and a liquid crystal capacitance $C_{lc}$. The other side terminal of the TFT-LCD pixel is typically connected to the common electrode signal line $V_{com}$.

In operation, when a voltage representing a greyness level to be displayed (a grey voltage) is applied to the data line of a pixel, and the on-voltage $V_{on}$ to operate the TFT is applied to the gate line, the light transmittance of the liquid crystal display corresponds to a difference in potential between the grey voltage and the common electrode voltage $V_{com}$. Therefore, the information is displayed on the liquid crystal display.

FIG. 2 shows typical electrode voltage waveforms applied to the common electrode and the gate electrodes of conventional TFT-LCDs. These waveforms show the typical common electrode voltage ($V_{com}$) inversion driving method, in which waveforms of different voltage levels are applied to the common electrode periodically and the common electrode voltage $V_{com}$ oscillates between two low voltage levels at a set frequency.

An on-voltage $V_{on}$ to drive the TFT and an off-voltage $V_{off}$ to stop driving of TFT are applied to the gate line. $V_{off}$ is always applied to the gate line except when the TFT is being driven by $V_{on}$. In addition, the $V_{off}$ waveform on the gate line should oscillate with the same phase and amplitude as the common electrode voltage $V_{com}$ because the liquid crystal capacitance $C_{lc}$ and the storage capacitor $C_s$ are connected between the gate line and the common electrode.

As shown in FIG. 3, the gate electrode voltage is generated in a conventional TFT-LCD driving device. When the start signal (STV) is inputted once, the gate bus driver integrated circuit (IC) outputs the gate electrode voltages and the grey voltage of the source line drives the liquid crystal capacitance $C_{lc}$.

FIG. 4 is a conventional gate array circuit diagram of an LCD interface IC which outputs the start signal STV. Start signal STV is generated when the 33rd horizontal synchronous signal $H_{sync}$ is inputted after the vertical synchronous signal $V_{sync}$ is cleared. A binary number 0000100001, corresponding to the decimal number 33, should be input to the NOR gate so that the start signal STV is generated concurrently with the 33rd horizontal synchronous signal.

However, in the above-mentioned conventional TFT-LCD driving device, when each gate line of pixels in TFT-LCD is driven by a single start signal STV, the driving speed of the LCD becomes slow. Additionally, where the TFT-LCD has insufficient current driving capacity, the driving potential applied to the liquid crystal capacitance $C_{lc}$ is insufficient. Therefore, conventional TFT-LCD drivers have several drawbacks which can cause an artificial reduction in the displayed grey level and can cause crosstalk in the liquid crystal display.

Although attempts have grown made at resolving these problems by increasing the duration of time in which the on-voltage $V_{on}$ is applied to the gate line of the TFT, thereby widening the $V_{on}$ pulse width, this pulse width is restricted by because the frame frequency of the image signal input to the liquid crystal display is fixed at 60 Hz.

SUMMARY OF THE INVENTION

An object of the present invention is to provide a driving device and a method of driving a TFT-LCD to obtain a clear picture in a liquid crystal display by insuring that the regular electric potential is sufficiently applied to the liquid crystal capacitor by applying the gate electrode voltage twice when driving TFT-LCD pixels under the common electrode voltage reversion driving method.

In order to achieve this object, the device of the present invention includes a liquid crystal interface IC which outputs a start signal STV which has two pulses and a clock signal $V_{CLK}$. A gate bus driver IC outputs a two pulse gate electrode voltage to each gate line according to the start signal inputted from the liquid crystal interface IC. Liquid crystal pixels are driven by the difference in potential between the grey voltage and the common electrode voltage after the TFT in each gate line is driven by the gate electrode voltage inputted from the gate bus driver IC.

A driving method according to the present invention includes the steps of generating a start signal STV concurrently with the 31st horizontal synchronous signal after the counting is cleared by the vertical synchronous signal, generating a start signal pulse STV concurrently with the 33rd horizontal synchronous signal, and applying the two pulse gate electrode voltage to the gate line of the TFT-LCD by twice applying the start signal STV to the gate bus driver IC.

BRIEF DESCRIPTION OF THE DRAWINGS

The preferred embodiments of the present invention will now be described more specifically with reference to the attached drawings, wherein.

DETAILED DESCRIPTION OF THE PRESENTLY PREFERRED EXEMPLARY EMBODIMENTS

The preferred embodiment of the present invention will now be described with reference to FIGS. 5–10.

Figure 1:
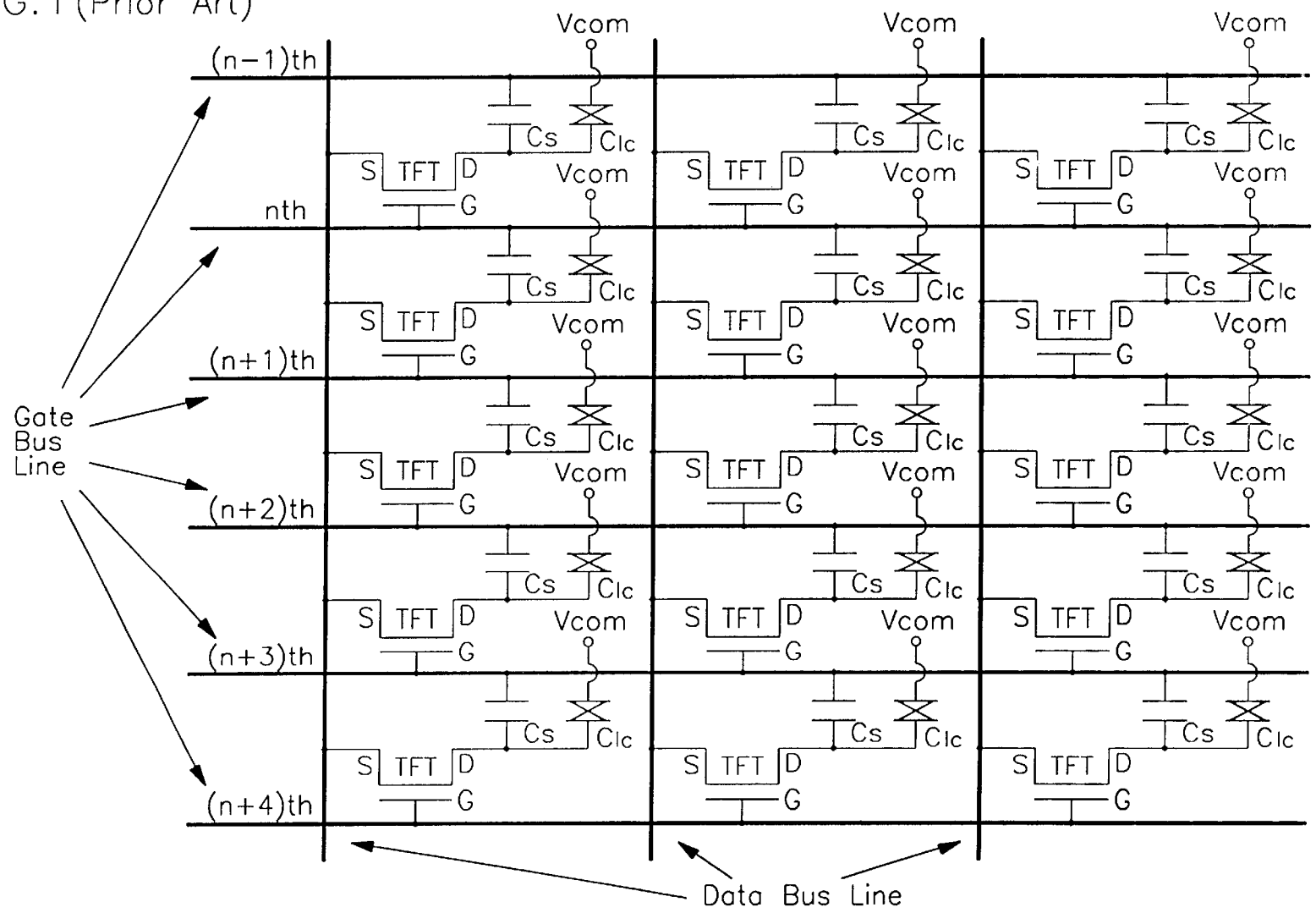
FIG. 1 (Prior Art)
FIG. 1 is an equivalent circuit diagram of pixels in a conventional TFT-LCD using the adjacent gate method.
Figure 2:
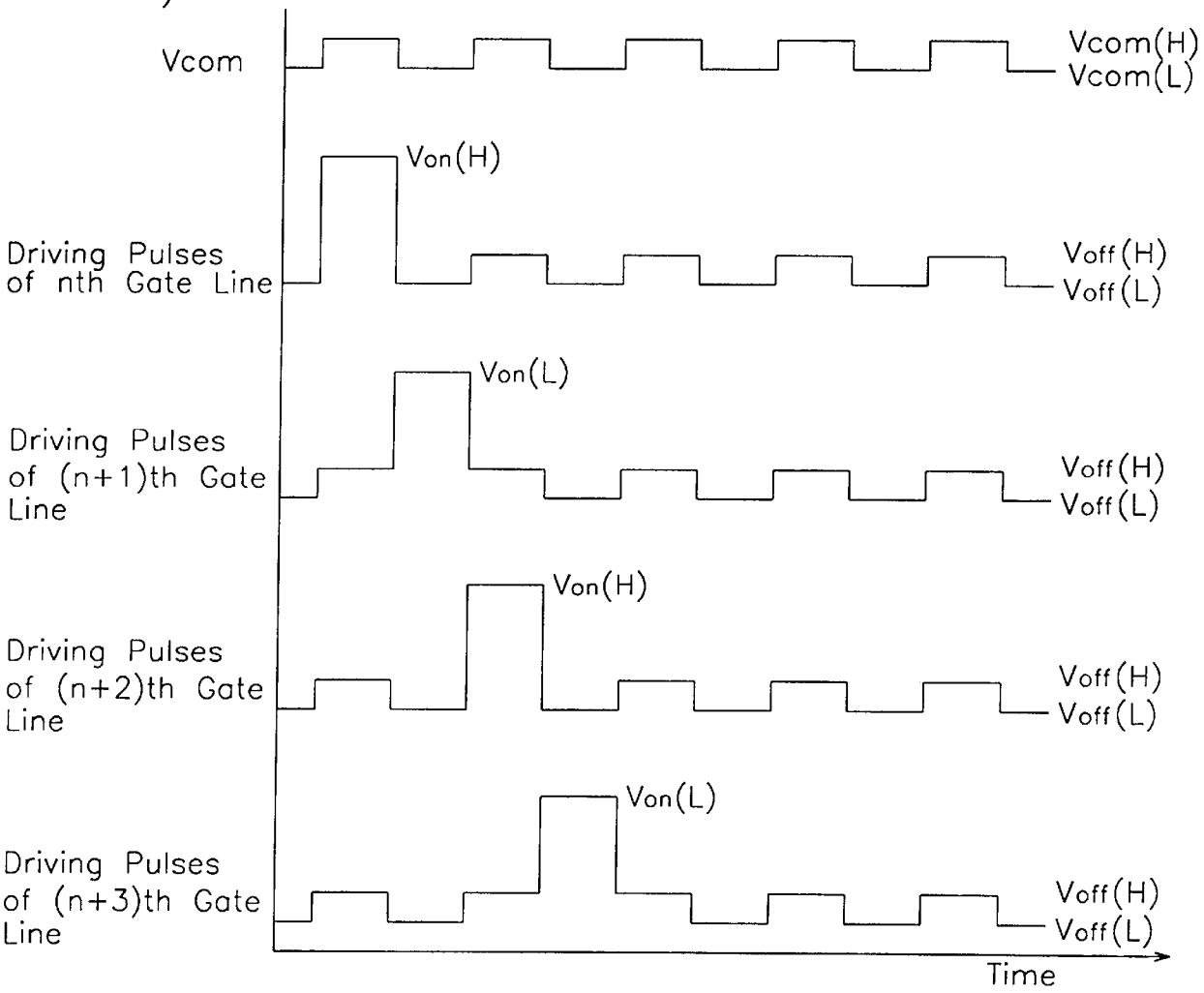
FIG. 2 (Prior Art)
FIG. 2 are typical waveforms of the common electrode voltage and the gate electrode voltages which are inputted to the conventional TFT-LCD shown in FIG. 1.
Figure 3:
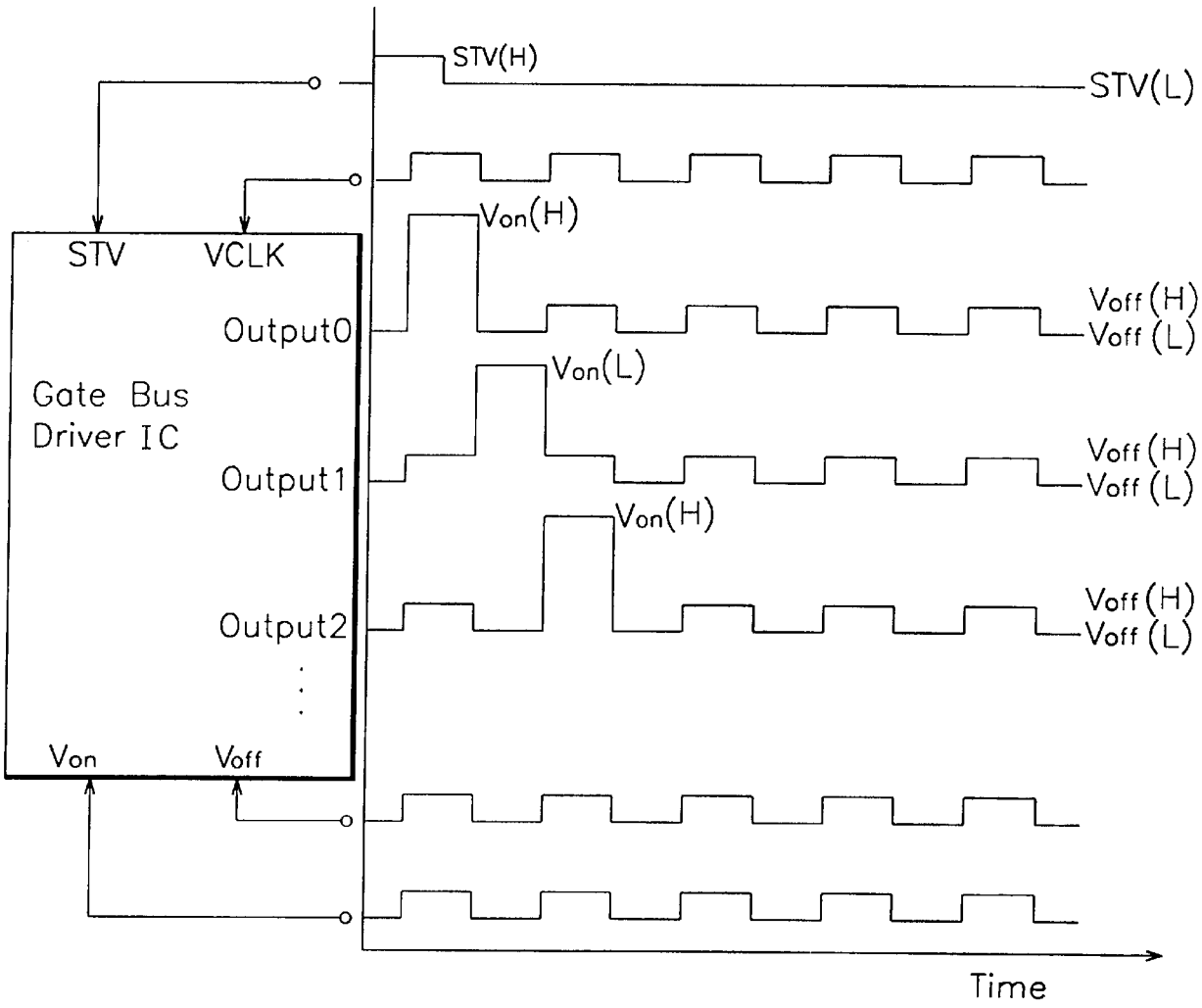
FIG. 3 (Prior Art)
FIG. 3 illustrates typical output voltage waveforms of gate electrodes which are generated in a driving device of the conventional TFT-LCD of FIG. 1.
Figure 4:
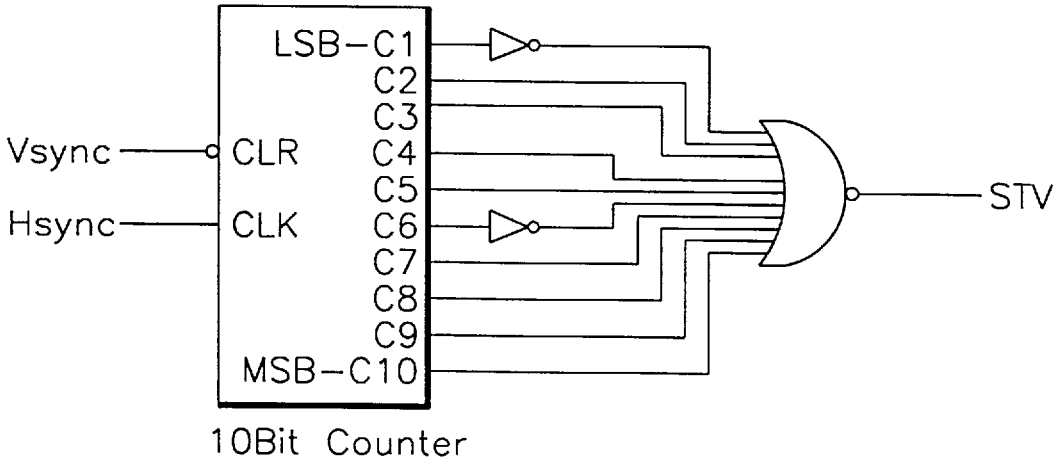
FIG.4 (Prior Art)
FIG. 4 is a gate array circuit diagram of a liquid crystal interface IC to generate a start signal for the conventional TFT-LCD of FIG. 1.
Figure 5:
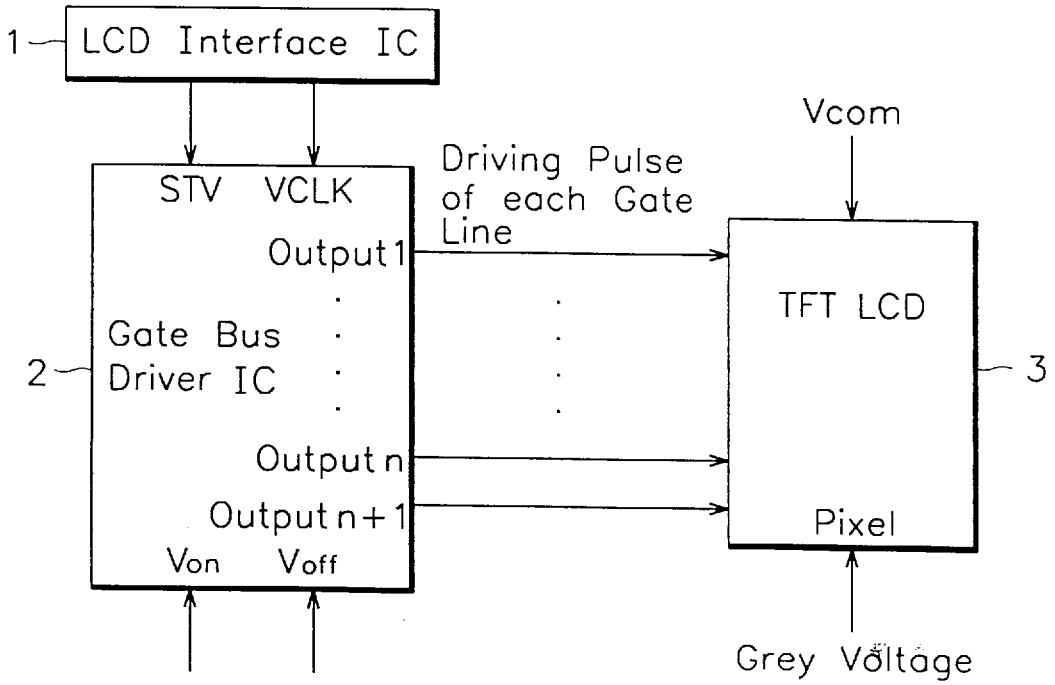
FIG. 5 is a block diagram of a driving device for a TFT-LCD according to a preferred embodiment of the present invention.

As shown in FIG. 5, a driving device of a TFT-LCD according to a preferred embodiment of the present invention includes a liquid crystal interface IC 1 which outputs a two-pulse start signal STV and a clock signal $V_{CLK}$. Gate bus driver IC 2 outputs two-pulse gate electrode voltage signals to each gate line according to the start signal inputted from the above liquid crystal interface IC 1. Liquid crystal pixels 3 receive the gate electrode voltages and drive the liquid crystal display according to the difference in potential between the grey voltage and the common electrode voltage $V_{com}$.

Figure 6:
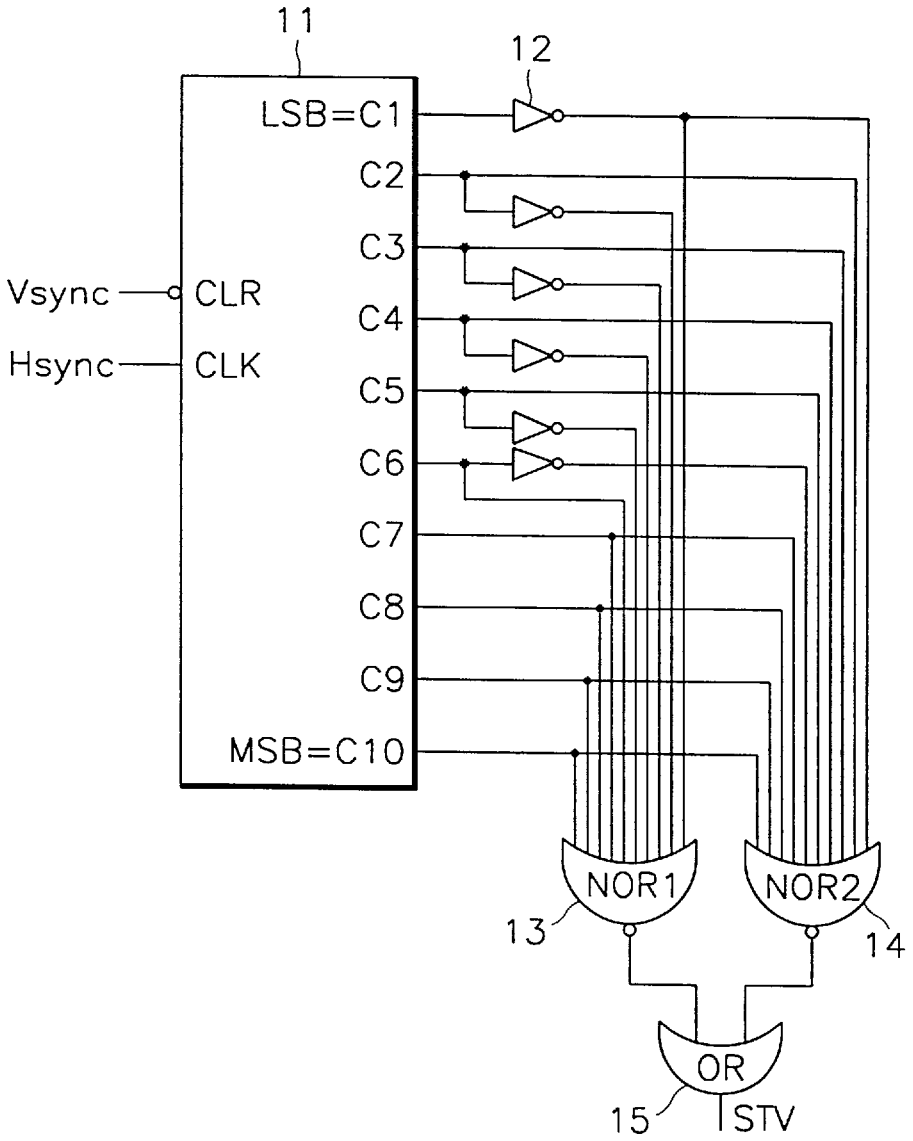
FIG. 6 is a gate array circuit diagram to be used to generate a start signal STV for a TFT-LCD according to a preferred embodiment of the present invention.

FIG. 6 is a gate array circuit diagram which generates the start signal STV according to the present invention.

As shown in FIG. 6, the gate array of the liquid crystal interface IC 1 includes a 10 bit counter 11 having input terminals connected to the vertical and horizontal synchronous signal lines $V_{sync}$ and $H_{sync}$. Inverters 12 invert the 6 low bit output signals $C_1$ to $C_6$ of the 10 total bits output by counter 11. A first NOR gate 13 is connected to the 6 inverted outputs and the four non-inverted outputs of the two bit counter which outputs a high signal when the binary digit is 00000111111. A second NOR gate 14 input to the 10 bit counter 11 outputs a high signal when the binary digit input to the 10 bit counter 11 is 0000100001. An OR gate 15 has its input terminals connected to the output terminals of the first and second NOR gates 13 and 14.

During operation, when power is applied to this TFT-LCD driving device, the liquid crystal interface IC 1, shown in FIG. 5, outputs the start signal STV and clock signal VCLK to the gate bus driver IC 2. The gate bus driver IC 2 applies a gate electrode voltage signal to each gate line of the TFT-LCD pixels 3 according to the pulses inputted to the input terminals $V_{on}$ and $V_{off}$. When each gate line of the TFT-LCD is driven, the TFT-LCD pixels 3 drive the liquid crystals if a grey voltage input to the source terminal is applied to the liquid crystal capacitor.

Figure 7:
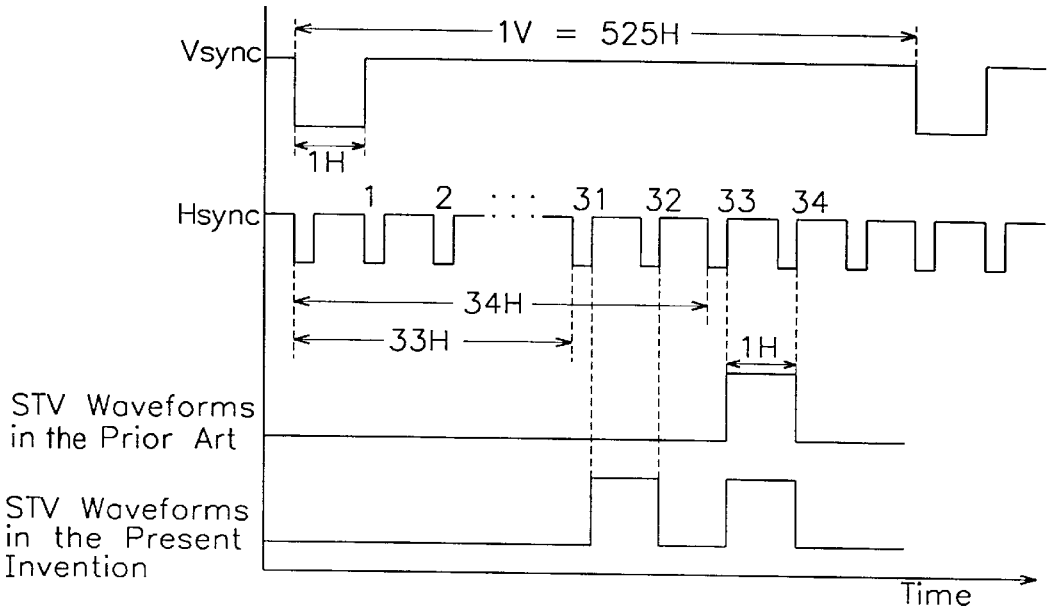
FIG. 7 illustrates a signal waveforms of a gate array according to a preferred embodiment of the present invention.

FIG. 7 is a timing diagram of output pulse of gate array which is in the liquid crystal interface IC as shown in FIG. 6.

In conventional TFT-LCDs, a one pulse start signal STV is generated concurrently with 33rd horizontal synchronous signal after the vertical synchronous signal has cleared the 10 bit counter. By contrast, in the present invention, the pulse of the start signal is generated twice concurrently with the 31st and 33rd horizontal synchronous signals after the vertical synchronous signals has cleared the 10 bit counter 11.

As shown in FIG. 7, in the present invention, after the 10 bits counter 11 is cleared by the vertical synchronous signal $V_{sync}$, the start signal having two pulses is outputted to the gate bus driver IC 2 concurrently with the 31st and 33rd horizontal synchronous signals $H_{sync}$. In this case, to generate the start signal pulse STV currently with the 31st horizontal synchronous signal $H_{sync}$, the binary digit 00000011111, equal to decimal numeral 31, should be input to the first NOR gate 13.

That is, to achieve a start signal STV having a high level, the input signal of the first NOR gate 13 should be a low level, or the input signal of the second NOR gate 14 should be a low level. At this time, some input signals C1 to C6 of the first NOR gate 13 are inputted to inverters to achieve the output signal of a high level in the first NOR gate 13, so that the input signal of the first NOR gate 13 should be 00000111111 as a binary numeral. Then, the output signal of the NOR gate 13 become a high level. Accordingly, the output signal of the OR gate 15 has a high level.

Likewise to generate start signal pulse STV concurrently with the 33rd horizontal synchronous signal $H_{sync}$, the binary digit 0000100001, equal to decimal numeral 33, should be inputted to the second NOR gate 14.

Figure 8:
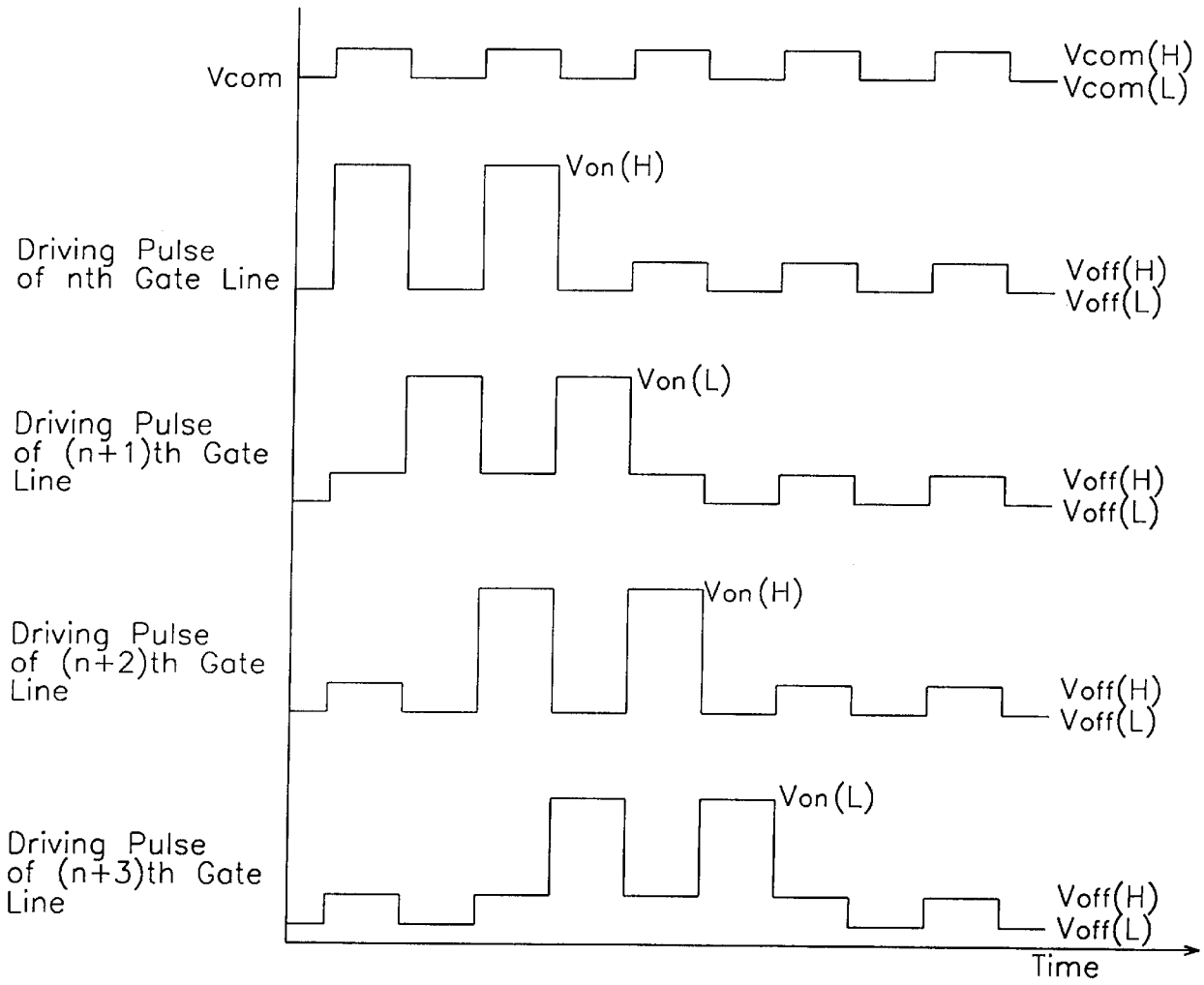
FIG. 8 illustrates waveforms of the common electrode voltage and each gate electrode voltage which are input to the TFT-LCD according to a preferred embodiment of the present invention.

FIG. 8 illustrates the waveforms of the common electrode voltage $V_{com}$ and gate electrode voltages which are input to the TFT-LCD. As shown in FIG. 8, the gate electrode voltage pulse is twice applied to the gate lines of the liquid crystal pixels. The first gate electrode driving pulse precharges the liquid crystal capacitor $C_{lc}$ and the grey voltage, which is applied to source terminal of the TFT-LCD is applied to the liquid crystal capacitor $C_{lc}$ by the second driving pulse.

Figure 9:
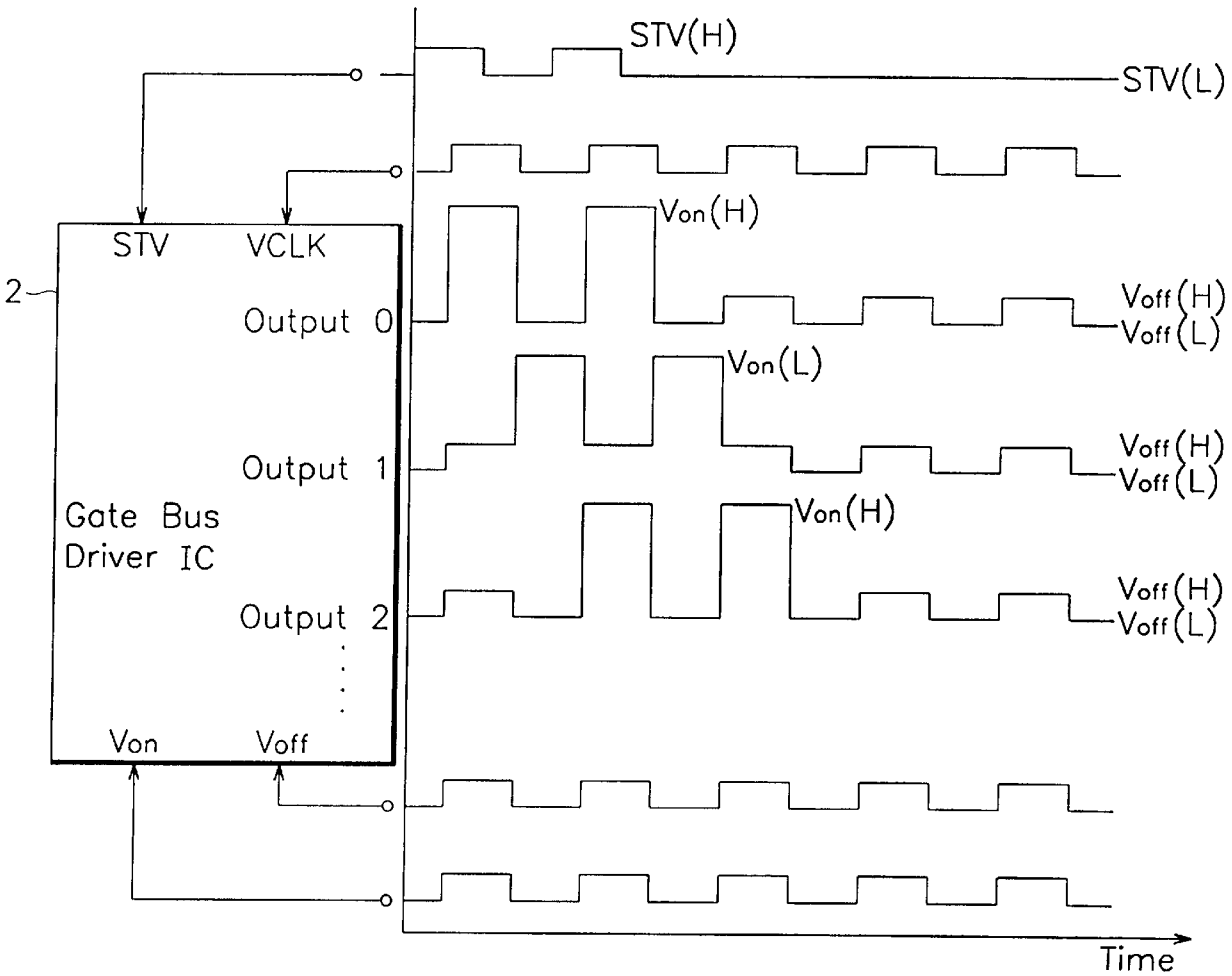
FIG. 9 illustrates output voltage waveforms of gate electrodes in a driving device of a TFT-LCD according to a preferred embodiment of the present invention.

As shown in FIG. 9, when the start signal STV which is generated by the gate array circuit of the liquid crystal interface IC is twice input to the gate bus driver IC 2, gate electrode voltage signal $V_{on}$ having two pulses are generated on each gate line.

The gate bus driver IC 2 includes a shift register. Therefore, the gate electrode on-voltage $V_{on}$ (H) and $V_{on}$ (L) is generated in order according to the period of the clock signal VCLK, and the gate electrode off-voltage $V_{off}$ (H) and $V_{off}$ (L) is generated the rest of the time. At this time, the pulse of the gate electrode voltage $V_{on}$ is shifted when the clock signal $V_{CLK}$ is shifted from the low level to the high level and the start signal STV is in the high level. Preferably, the output terminal number of the Gate Bus Driver IC 2 is the same as the gate line numbers to which the gate electrode voltage is applied.

The pulse which is inputted to the input terminal $V_{on}$, $V_{off}$ of the gate bus driver IC 2 makes the pulses of the gate electrode voltage oscillate according to the common electrode voltage signal $V_{com}$ so that the TFT is driven by a fixed electric potential and the electric potential of the liquid crystal capacitor $C_{lc}$ and the storage capacitor $C_s$ is adjusted to the commmon electrode voltage $V_{com}$ when the TFT-LCD is not being driven.

Figure 10:
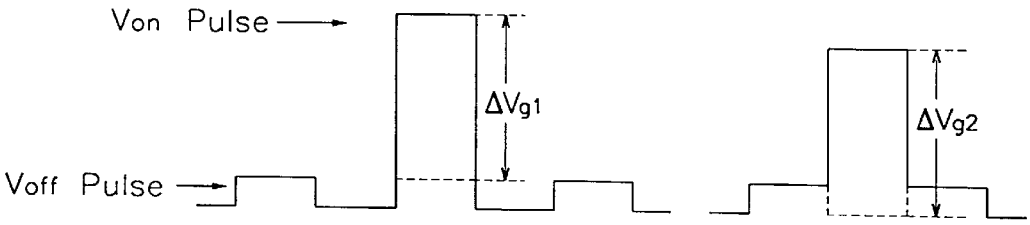
FIG. 10 illustrates a waveform showing that gate electrode voltage $V_{on}$ maintains a fixed potential difference independent of the oscillation of the driving stop signal $V_{off}$ of the TFT-LCD according to a preferred embodiment of the present invention.

FIG. 10 illustrates how the gate electrode voltage $V_{on}$ maintains a fixed electric potential during oscillation of the driving stop signal $V_{off}$ of the TFT-LCD in the present invention. As shown in FIG. 10, the difference in potential between ΔVg1 and ΔVg2 should be always same.

As described above, the present invention provides a driving device and a driving method for a TFT-LCD in which the liquid crystal pixels are correctly driven by applying a two-pulse gate electrode voltage which have the effect of doubling the duration of the driving pulse.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art which this invention pertains.

What is claimed is:

1. A method of driving a TFT-LCD, comprising the steps of:

generating a first start signal concurrently with a $31^{st}$ horizontal synchronous signal;

generating a second start signal concurrently with a $33^{rd}$ horizontal synchronous signal; and applying a two-pulse gate electrode voltage signal to a gate line of said TFT-LCD by applying said first and second start signals to a gate bus driver IC.

2. A driving device of a thin film transistor-liquid crystal display (TFT-LCD) comprising:

a plurality of gate lines, each gate line including a thin film transistor;

a liquid crystal interface integrated circuit (IC) which outputs a start signal;

a gate bus driver integrated circuit (IC) which outputs a gate electrode voltage having a first and second gate-on pulse to each of said plurality of gate lines according to said start signal inputted from said liquid crystal interface IC, wherein said first gate-on pulse is applied to the $N+1^{th}$ gate line at a time between the times when said first gate-on pulse and said second gate-on pulse are applied to the $N^{th}$ gate line; and a liquid crystal pixel associated with each thin film transistor, each liquid crystal pixel being driven by a difference in potential between a grey voltage and a common electrode voltage after said thin film transistor associated with each gate line is driven by the gate electrode voltages output from the gate bus driver integrated circuit;

said liquid crystal interface IC including:

a counter which counts input horizontal synchronous signals after a vertical synchronous signal has cleared the counter;

inverters which invert output signals of said counter; and logic operation means which receives output signals from said counter and output signals from said inverters and outputs said start signal; and said logic operation means;

a first NOR gate and a second NOR gate which receive signals output from said inverters and signals output from said counter; and a OR gate which receives a signal output from said first NOR gate and a signal output from said second NOR gate;

wherein said start signal is a two-pulse start signal.

3. A driving device of a TFT-LCD as defined in claim 2, wherein said counter is 10 bit counter, said first NOR gate outputs a high signal when a binary digit signal from said 10 bit counter is 0000011111 and said second NOR gate outputs a high signal when a binary digit signal from said 10 bit counter is 0000100001.

4. A method of driving a TFT-LCD comprising the steps of:

generating a start signal; and applying a gate electrode voltage having a first and a second gate-on pulse to gate lines of said TFT-LCD by applying said start signal to a gate bus driver IC;

wherein said first gate-on pulse is applied to the $N+1^{th}$ gate line at a time between the times when said first gate-on pulse and said second gate-on pulse are applied to the $N^{th}$ gate line; and said step of generating a start signal comprises the steps of:

clearing a counter by a vertical synchronous signal;

generating the first start pulse signal at the $N^{th}$ horizontal synchronous signal after said step of clearing; and generating the second start pulse signal at the $N+2^{th}$ horizontal synchronous signal after said step of clearing.

5. A driving device of a thin film transistor-liquid crystal display (TFT-LCD) comprising:

a plurality of gate lines, each gate line including a thin film transistor;

a liquid crystal interface integrated circuit (IC) which outputs a start signal;

a gate bus driver integrated circuit (IC) which outputs a gate electrode voltage having a first and a second gate-on pulse to each of said plurality of gate lines according to said start signal inputted from said liquid crystal interface IC; and a liquid crystal pixel associated with each thin film transistor, each liquid crystal pixel being driven by a voltage difference between a grey voltage and a common electrode voltage after said thin film transistor associated with each gate line is driven by said gate electrode voltage output from the gate bus driver integrated circuit;

wherein said first gate-on pulse and said second gate-on pulse are applied to a $N^{th}$ gate line during a $N^{th}$ gate-on period which lasts between the times when the first gate-on pulse applied to the $N^{th}$ gate line begins and the second gate-on pulse applied to the $N^{th}$ gate ends;

said first gate-on pulse and said second gate-on pulse are applied to a $N+1^{th}$ gate line during a $N+1^{th}$ gate-on period which lasts between the times when the first gate-on pulse applied to the $N+1^{th}$ gate line begins and the second gate-on pulse applied to the $N+1^{th}$ gate line ends;

said $N^{th}$ and $N+1^{th}$ gate-on periods overlap;

said liquid crystal interface IC comprises:

a counter which counts input horizontal synchronous signals after a vertical synchronous signal has cleared the counter;

inverters which invert output signals from said counter;

logic operation means which receives output signals from said counter and output signals from said inverters and outputs said start signal;

said start signal is two-pulse start signal; and said logic operation means comprises:

a first NOR gate and a second NOR gate which receive signals output from said inverters and signals output from said counter; and a OR gate which receives a signal output from said first NOR gate and a signal output from said second NOR gate.

6. A driving device of a TFT-LCD as defined in claim 5 wherein said counter is a 10 bit counter, said first NOR gate outputs a high signal when a binary digit signal from said 10 bit counter is 0000011111 and said second NOR gate outputs a high signal when a binary digit signal from said 10 bit counter is 0000100001.

7. A method of driving a TFT-LCD comprising the steps of:

generating a start signal; and applying a gate electrode voltage having a first and a second gate-on pulse to gate lines of said TFT-LCD by applying said start signal to a gate bus driver IC;

wherein said first gate-on pulse and said second gate-on pulse are applied to a $N^{th}$ gate line during a $N^{th}$ gate-on period which lasts between the times when the first gate-on pulse applied to the $N^{th}$ gate line begins and the second gate-on pulse applied to the $N^{th}$ gate ends;

said first gate-on pulse and said second gate-on pulse are applied to a $N+1^{th}$ gate line during a $N+1^{th}$ gate-on period which lasts between the times when the first gate-on pulse applied to the $N+1^{th}$ gate line begins and the second gate-on pulse applied to the $N+1^{th}$ gate line ends;

said $N^{th}$ and $N+1^{th}$ gate-on periods overlap; and said step of generating a start signal comprising the steps of:

clearing a counter by a vertical synchronous signal;

generating the first start pulse signal at the $N^{th}$ horizontal synchronous signal after said step of clearing; and generating the second start pulse signal at the $N+2^{th}$ horizontal synchronous signal after said step of clearing.

8. A driving device of a thin film transistor-liquid crystal display (TFT-LCD) comprising:

a plurality of gate lines, each gate line including a thin film transistor;

a liquid crystal interface integrated circuit (IC) which outputs a two-pulse start signal;

a gate bus driver integrated circuit (IC) which outputs two-pulse gate electrode voltages to each of said plurality of gate lines according to said two-pulse start signal input from said liquid crystal interface; and a liquid crystal pixel associated with each thin film transistor, each liquid crystal pixel being driven by a difference in potential between a grey voltage and a common electrode voltage after said thin film transistor associated with each gate line is driven by the two-pulse gate electrode voltages output from the gate bus driver;

wherein said liquid crystal interface IC includes:

a 10 bit counter which counts input horizontal synchronous signals after a vertical synchronous signal has cleared the 10 bit counter and generates 10 output signals corresponding to the number of counted vertical synchronous signals;

inverters which invert 6 bit output signals of said 10 bit counter;

a first NOR gate which outputs a high signal when a binary digit output from said 10 bit counter is 00000111111;

a second NOR gate which outputs the high signal when binary digit output from said 10 bit counter is 0000100001; and an OR gate which receives outputs of the first and the second NOR gates to output the two-pulse start signal.

* * * * *